US005177857A

United States Patent [19]

Ito

[11] Patent Number: 5,177,857

[45] Date of Patent: Jan. 12, 1993

[54] METHOD FOR HOLDING AN OBJECT TO A SURFACE USING VALVE CONTROLLED VACUUM FORCE

[75] Inventor: Hirotsugu Ito, Chita, Japan

[73] Assignee: FSK Inc., Aichi, Japan

[21] Appl. No.: 734,638

[22] Filed: Jul. 23, 1991

Related U.S. Application Data

[62] Division of Ser. No. 595,357, Oct. 9, 1990, Pat. No. 5,048,804.

[30] Foreign Application Priority Data

May 17, 1990 [JP] Japan ..... 2-127389

[51] Int. Cl.[5] ..... B25B 11/00

[52] U.S. Cl. ..... 29/559; 269/21

[58] Field of Search ..... 248/362, 363; 269/21, 269/20; 51/235; 294/69 R, 69 A, 69 B, 65; 279/3 R; 29/559

[56] References Cited

U.S. PATENT DOCUMENTS 2,680,994 5/1954 Wood .
2,782,574 2/1957 Copold .
2,855,653 10/1958 Kastenbein .
3,307,819 3/1967 Cocito .
3,460,822 8/1969 Link .
3,484,093 12/1969 Mermelstein .
3,907,268 9/1975 Hale .

FOREIGN PATENT DOCUMENTS 141661 5/1980 Fed. Rep. of Germany .

*Primary Examiner*—Robert C. Watson
*Attorney, Agent, or Firm*—Frishauf, Holtz, Goodman & Woodward

[57] ABSTRACT

A technique of holding an object, wherein an object (10) to be held is placed on a holding surface (3) having a plurality of suction holes (4), each of which has a valve (6) therein which is operated in accordance with the difference between the pressure in the upper or outer space and the pressure in the lower or inner space demarcated by the valve (6). The valve (6) is opened by utilizing the phenomena that such pressure difference in those suction holes (4) closed by the object (10) becomes smaller, whereas the valves (6) are closed by utilizing the phenomena that such pressure difference in those suction holes (4) which are not closed by the object (10) and remain open becomes greater, to thereby prevent reduction of the suction force to be exerted on the object (10).

10 Claims, 2 Drawing Sheets

METHOD FOR HOLDING AN OBJECT TO A SURFACE USING VALVE CONTROLLED VACUUM FORCE

This is a division of application Ser. No. 07/595,357 filed Oct. 9, 1990, now U.S. Pat. No. 5,048,804.

BACKGROUND OF THE INVENTION

This invention relates to a method of holding an object, for example, for holding a work piece on the work holder of a machine tool.

As the methods of holding an object on the work table of a machine tool, a mechanical chucking means or magnetic force is usually used. However, these methods suffer disadvantages in that the mechanical chucking means tends to have a complicated structure and to be expensive, whereas the magnetic force method is not applicable when the object to be held is of nonmagnetic material.

In order to overcome these problems, a method has been contrived to hold an object on a work holder by utilizing the vacuum force exerted through a plurality of suction holes formed on the work holder. This method, however, suffers a problem that most of the suction holes remain open after an object is loaded on the work holder, depending on the shape of the object, and air of atmospheric pressure is sucked through such open suction holes, so that only reduced suction force can be exerted on the object to be held.

This invention has been accomplished with a view to solving the problems inherent in the prior art as described above and provides a technique of holding an object, whatever shape it may have, by allowing suction forces to surely act only upon the contact area of the object from those suction holes which are closed by said object and preventing a drop in the suction force therein.

SUMMARY OF THE INVENTION

According to the present invention, a method for holding an object to a surface comprises providing a holding surface for receiving an object to be held thereon, said holding surface having a plurality of suction holes therein; providing a vacuum source coupled to said suction holes for applying a suction force to said suction holes, said vacuum source comprising a vacuum chamber below said suction holes; providing valve means in each of said suction holes, said valve means being located between an outer space above said holding surface and said vacuum source, said valve means each being operable in accordance with a pressure difference between said outer space above said holding surface and an inner space within said vacuum source, and said valve means comprising a flexible resilient valve member arranged above a valve seat, said flexible resilient valve member comprising a peripheral leg member for normally spacing said flexible valve member away from said valve seat, and said flexible valve member being flexibly movable toward and away from said valve seat responsive to said pressure difference; biasing, with a biasing force, said respective flexible valve members resiliently away from said respective valve seats to place said valve means in an open position whereby communication is provided between said outer space above said holding surface and said inner space within said vacuum source via said valve means and said suction holes; maintaining said valve means in said open position when said pressure difference in suction holes that are closed or covered by an object becomes smaller than a predetermined value; and closing said valve means to stop communication between said vacuum source and said outer space above said holding surface when a pressure difference in suction holes that are not closed by the object and that remain open becomes greater than a predetermined value; thereby preventing loss of suction force to be exerted on the object due to loss through open suction holes.

DESCRIPTION OF PREFERRED EMBODIMENTS

Figure 1:
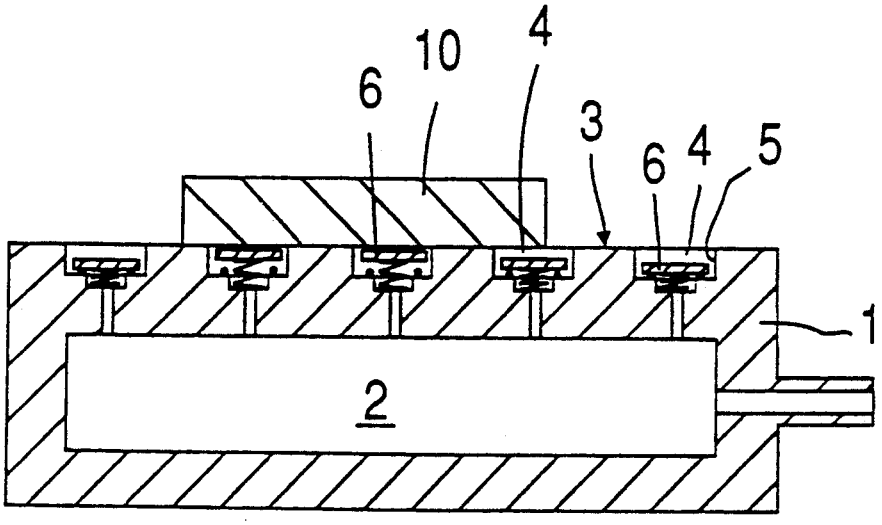
FIG. 1 shows a cross section of a first embodiment of the apparatus of this invention.
Figure 2:
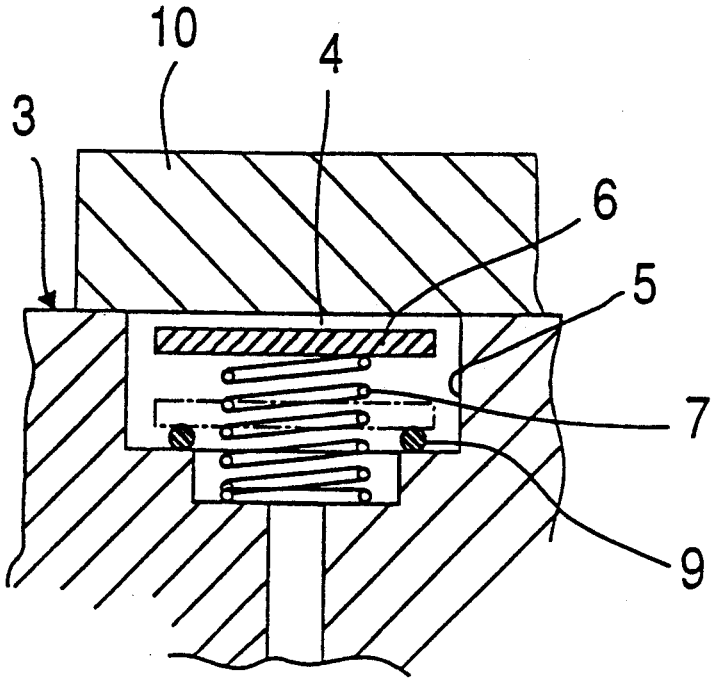
FIG. 2 shows an enlarged cross section of the major section of the apparatus shown in FIG. 1.

In FIGS. 1 and 2, the reference numeral (1) shows a work holder having a vacuum source such as a vacuum chamber (2) therein, and the holding surface (3) thereof has a plurality of suction holes (4). The lower end of each suction hole (4) communicates to the vacuum chamber (2), and a valve (6) is disposed in the enlarged diameter portion (5) formed adjacent to the holding surface (3), said valve (6) having a diameter slightly smaller than that of the enlarged diameter portion (5).

As shown in the enlarged view of FIG. 2, the valve (6) is urged upward or outward by a coil spring (7) so that it can be operated in accordance with the difference between the pressure in the outer space and that of the inner space demarcated by said valve. Namely, when the suction hole (4) is closed by an object (10), as shown in FIG. 2, the internal space of the suction hole (4) is subjected to substantially uniform pressure, in other words, the difference between the pressure in the outer space and that in the inner space demarcated by said valve (6) becomes smaller, since the amount of air flowing through the gap between the holding surface (3) and the object (10) is small, so that the valve (6) is urged upward by the coil spring (7). On the contrary, when the suction hole (4) is not closed by the object (10) and remains open, a large amount of air flows from the upper opening of the suction hole (4), so that the outer space above the valve (6) is subjected to atmospheric pressure, whereas the inner space below the valve (6) is subjected to reduced pressure exerted from the vacuum chamber (2). Accordingly, the difference between the pressure in the outer space and that in the inner space demarcated by said valve (6) becomes greater, so that the valve (6) is pulled downward onto the O-ring (9) against the resilience of the coil spring (7), as shown by the dashed line in FIG. 2. Consequently, when the suction hole (4) is closed by the object (10), the valve (6) assumes an open posture; whereas when the suction hole (4) remains open, the valve (6) assumes a closed posture.

Thus, if a suction force is exerted from the vacuum chamber (2) to the object (10) loaded on the holding surface (3), the valves (6) are opened in those suction holes (4) which are closed by the object (10), and the object (10) is sucked thereon whereas in those suction holes (4) which are not closed by the object (10) and remain as open, the valves (6) are closed to prevent loss of suction force. Such opening and closing of the valve (6) is carried out automatically depending on the shape or size of the object (10), so that any shapes of objects (10) can surely be sucked and held on the holding surface (3).

Figure 3:
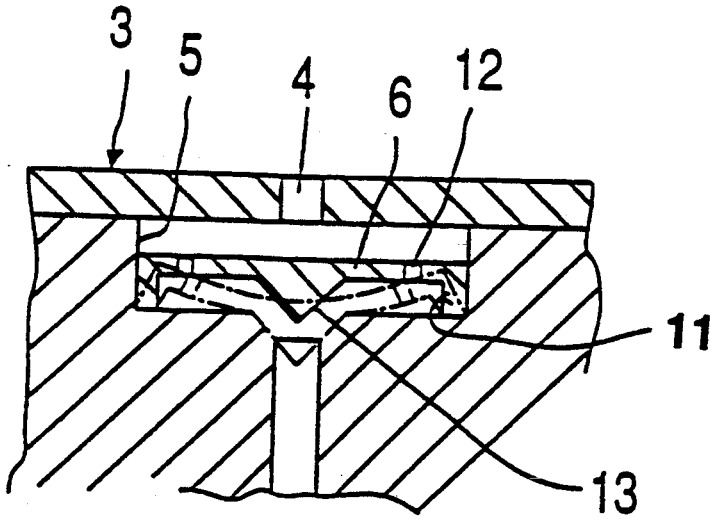
FIG. 3 shows, in enlarged cross-sectional view, the major section of a second embodiment of the apparatus of this

While a plate-like valve (6) is used in the first embodiment described above, the valve (6) accommodated in the enlarged diameter portion (5) in the second embodiment shown in FIG. 3 has a leg (11) along the edge thereof, small openings (12) and a projection (13) on the bottom surface. This valve (6) comprises elastic materials such as rubber, which assumes an open posture as shown by the solid line due to the resilience thereof and is deformed as shown by the dashed line when the suction hole (4) is open, so that the projection (13) closes the channel communicating to the vacuum chamber (2).

Figure 4:
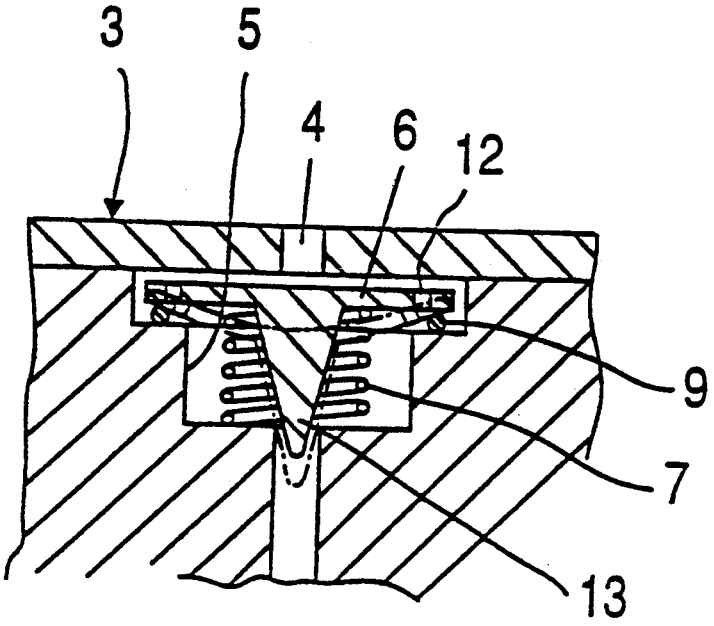
FIG. 4 shows, in enlarged cross-sectional view, the major section of a third embodiment of the apparatus of this invention.

In the third embodiment shown in FIG. 4, while the size of the projection 13) formed on the bottom surface of the valve (6) is increased and vertical opening/closing motion of the valve is designed to be carried out with the aid of a coil spring (7), the valve (6) is operated in the substantially same manner as in the above described embodiments.

According to this invention, suction forces can surely be exerted only on the contact area of an object, whatever shape it may have, from those suction holes which are closed by said object, preventing air to be sucked from the open suction holes to prevent drop in the suction force to be exerted onto the object, as described above. Therefore, this invention enables secured holding of objects on a holding surface. As soon as the suction force exerted from the vacuum chamber to the object is interrupted, the force being applied thereto will be nil and the object can be released from the holding surface.

Accordingly, this invention can be utilized for holding a wide variety of objects including the case of holding a work piece on the work holder of a machine tool.

What is claimed is:

1. A method for holding an object to a surface, comprising:

providing a holding surface for receiving an object to be held thereon, said holding surface having a plurality of suction holes therein;

providing a vacuum source coupled to said suction holes for applying a suction force to said suction holes, said vacuum source comprising a vacuum chamber below said suction holes;

providing valve means in each of said suction holes, said valve means being located between an outer space above said holding surface and said vacuum source, said valve means each being operable in accordance with a pressure difference between said outer space above said holding surface and an inner space within said vacuum source, and said valve means comprising a flexible resilient valve member arranged above a valve seat, said flexible resilient valve member comprising a peripheral leg member for normally spacing said flexible valve member away from said valve seat, and said flexible valve member being flexibly movable toward and away from said valve seat responsive to said pressure difference;

biasing, with a biasing force, said respective flexible valve members resiliently away from said respective valve seats to place said valve means in an open position whereby communication is provided between said outer space above said holding surface and said inner space within said vacuum source via said valve means and said suction holes;

maintaining said valve means in said open position when said pressure difference in suction holes that are closed or covered by an object becomes smaller than a predetermined value; and closing said valve means to stop communication between said vacuum source and said outer space above said holding surface when a pressure difference in suction holes that are not closed by the object and that remain open becomes greater than a predetermined value;

thereby preventing loss of suction force to be exerted on the object due to loss through open suction holes.

2. The method of claim 1, wherein said step of closing said valve means comprises moving said respective flexible resilient valve members resiliently toward said respective valve seats to place said valve means in a closed position.

3. The method of claim 1, further comprising providing a projection member at a central portion of said flexible resilient valve member for seating against said valve seat upon resilient movement of said valve member toward said valve seat responsive to said pressure difference.

4. The method of claim 3, further comprising providing a spring means for biasing said central projection member away from said valve seat.

5. The method of claim 1, further comprising providing a flexible sheet-like valve member having at least one opening therein as said valve member.

6. A method for holding an object to a surface, said method comprising:

providing a holding surface for receiving an object to be held thereon, said holding surface having a plurality of suction holes therein;

providing a vacuum source coupled to said suction holes for applying a suction force to said suction holes, said vacuum source comprising a vacuum chamber below said suction holes;

providing valve means in each of said suction holes, said valve means being located between an outer space above said holding surface and said vacuum source, said valve means each being operable in accordance with a pressure difference between said outer space above said holding surface and an inner space within said vacuum source, and said valve means comprising a flexible resilient valve member arranged above a valve seat, said flexible resilient valve member comprising a peripheral leg member for normally spacing said flexible valve member away from said valve seat, said flexible valve member further comprising a central projection member for selectively seating against said valve seat, and said flexible valve member being flexibly movable toward and away from said valve seat responsive to said pressure difference;

biasing, with a biasing force, said respective flexible valve members resiliently away from said respective valve seats to place said valve means in an open position whereby communication is provided between said outer space above said holding surface and said inner space within said vacuum source via said valve means and said suction holes;

maintaining said valve means in said open position when said pressure difference in suction holes that are closed or covered by an object becomes smaller than a predetermined value; and closing said valve means to stop communication between said vacuum source and said outer space above said holding surface when a pressure difference in suction holes that are not closed by the object and that remain open becomes greater than a predetermined value;

thereby preventing loss of suction force to be exerted on the object due to loss through open suction holes.

7. The method of claim 6, wherein said stop of closing said valve means comprises moving said respective flexible valve members resiliently toward said respective valve seats to seat said respective central portions against said respective valve seats to place said valve means in a closed position.

8. The method of claim 6, further comprising providing a means for biasing said central projection member away from said valve seat.

9. The method of claim 8, further comprising providing a coil spring surrounding said central projection member as said means for biasing said central projection member away from said valve seat.

10. The method of claim 6, further comprising providing a flexible sheet-like valve member having at least one opening therein as said valve member.

* * * * *